United States Patent [19]

Hutchins

[11] Patent Number: 4,714,440

[45] Date of Patent: Dec. 22, 1987

[54] UNIVERSAL ADAPTER AND METHODS OF AND APPARATUS FOR MAKING SAME

[75] Inventor: Erle M. Hutchins, Bel Air, Md.

[73] Assignee: American Telephone and Telegraph Company, AT&T Technologies, Inc., Berkeley Heights, N.J.

[21] Appl. No.: 792,086

[22] Filed: Oct. 28, 1985

[51] Int. Cl.[4] ..... H01R 23/02

[52] U.S. Cl. ..... 439/676; 439/870; 439/741

[58] Field of Search ..... 339/176 M, 154–156, 339/166; 29/874, 876, 884

[56] References Cited

U.S. PATENT DOCUMENTS

| | | | |
|---|---|---|---|
| 3,409,972 | 11/1968 | Cervenka et al. | 29/203 |
| 3,556,166 | 1/1971 | Whitney | 140/71 |
| 3,562,903 | 2/1971 | Busler et al. | 29/602 |
| 3,699,498 | 10/1972 | Hardesty et al. | 339/64 M |
| 3,761,869 | 9/1973 | Hardesty et al. | 339/99 R |
| 3,947,958 | 4/1976 | Bowers | 339/99 R |
| 4,241,974 | 12/1980 | Hardesty | 339/154 A |
| 4,268,109 | 5/1981 | Hardesty | 339/205 |
| 4,292,736 | 10/1981 | Hughes | 29/884 |
| 4,296,550 | 10/1981 | Kobler | 29/884 |
| 4,367,908 | 1/1983 | Johnston | 339/154 A |
| 4,379,609 | 4/1983 | Hardesty | 339/91 R |
| 4,392,373 | 7/1983 | Clark | 72/321 |
| 4,438,998 | 3/1984 | Myers | 339/154 A |
| 4,444,451 | 4/1984 | Myers | 339/154 A |
| 4,488,355 | 12/1984 | Hutchins et al. | 29/882 |

OTHER PUBLICATIONS

Hutchins Application Ser. No. 645,182 filed 8/29/84.

*Primary Examiner*—Gil Weidenfeld
*Assistant Examiner*—David Pirlot
*Attorney, Agent, or Firm*—Edward Somers

[57] ABSTRACT

A modular adapter (30) includes a housing (33) having a plug end portion (34) and a jack end portion (35). The jack end includes two stacked jack cavities (54–54'). Each of the jack cavities has a stepped portion (75) depending from the ceiling on each side of the centerline of the cavity. The stepped portions in each cavity are spaced apart a sufficient distance to receive a locking tab (41) of a modular plug (31) which is inserted into the cavity. The plug may be a six or an eight conductor plug. A first group of contact elements (36—36) extend from retroflexed end portions in one of the jack cavities into cells formed in the plug end portion. An additional two contact elements (37—37) comprising a second group have retroflexed end portions on one side of one jack cavity and extend to center positions in the other jack cavity. Portions of the stepped portions which depend from the ceiling of the one jack cavity are spaced from the sidewall of the housing to allow the end portion of an outermost one of the additional two contact elements and an outermost one of the first group to be formed into a retroflexed configuration. This arrangement allows the forming of end portions of the contact elements in addition to providing suitable guides for the locking tab of a plug which is inserted into the one jack cavity.

17 Claims, 25 Drawing Figures

UNIVERSAL ADAPTER AND METHODS OF AND APPARATUS FOR MAKING SAME

TECHNICAL FIELD

This invention relates to a modular adapter and to methods of and apparatus for making the adapter. More particularly, the adapter which comprises a plug end and two stacked jack cavities includes metallic contact elements which not only provide communications paths between the plug end and one of the jack cavities, but also power paths between the jack cavities.

BACKGROUND OF THE INVENTION

In comunications systems, it is well known to use modular plugs and jacks to establish connections. Modular plugs each include a plurality of blade-like terminals having tangs which engage electrically conductors of a cord end that is secured within a housing of the plug. Modular jacks each include a plurality of wire-like contact elements to each of which is connected an insulated conductor and a cavity for receiving a plug with retroflexed end portions of the contact elements being disposed in the cavity to engage the terminals of the plug inserted into the cavity.

A well known adapter includes a housing having a plug end and a jack end which includes two stacked jack cavities. See U.S. Pat. No. 4,241,974 which issued on Dec. 30, 1980, in the name of E. C. Hardesty and which is incorporated by reference hereinto. Metallic contact elements extend from one jack cavity to the plug end, which is adapted to be received in a wall jack for example, and to the other jack cavity. Each end portion of each contact element in a jack cavity is retroflexed to engage electrically a terminal of a plug which is inserted into that jack cavity.

In one variation of the above described adapter, it becomes necessary to have one of the jack cavities adapted to receive a plug having communications terminals and to have the other jack cavity adapted to receive a plug which provides low voltage power, for example, to the adapter. Connections must be made between the communications terminals of the plug in the one jack cavity to the wall jack and between power terminals of the plug in the one jack cavity and the power-supplying plug in the other cavity. Typically this variation involves only a few connections which must be made from the one jack cavity to the other jack cavity but a plurality which must be made from the one jack cavity into the plug end to establish communications paths between it and the wall jack.

This capability has been provided by an adapter having a housing which includes two side by side jack cavities and a plug end. It includes eight contact element end portions which are disposed in one of the jack cavities and six end portions in the plug end. For power, two contact element portions are provided in the other jack cavity. Harness type wiring which includes insulated conductors is used to connect six of the metallic contact portions in the one jack cavity with the six metallic contact portions in the plug end. Such wiring also is used to connect two of the metallic contact portions in the one jack cavity to the two metallic contact portions in the other jack cavity. Although, this adapter provides the needed capability, it involves harness wiring which is relatively expensive. Clearly, there is a need to provide an adapter which provides the same capability within existing dimensional constraints but one which does not involve harness type wiring.

Adapters involving contact element communications paths without harness wiring are known. For example, see the adapter disclosed in priorly mentioned U.S. Pat. No. 4,241,974 which was intended to replace a side-by-side jack cavity adapter. Another example of a modular device having end-to-end contact elements is that shown in U.S. Pat. No. 4,488,355 which issued on Dec. 18, 1984 in the names of E. M. Hutchins et al.

In each of the last-described modular adapters, the contact elements are assembled to the housing and their end portions formed into retroflexed configurations by automatic assembly apparatus. See also application Ser. No. 645,182 which was filed on Aug. 29, 1984 in the name of E. M. Hutchins. Wires are positioned in the housing with end portions disposed in an array in each jack cavity. Tooling is inserted into each cavity to engage the array of wire ends and to curl them about a lip to direct them inwardly into the cavity. This presents no problems in a six conductor jack cavity inasmuch as there are no obstructions to the bending of the wire ends. However, in going to eight conductors in a jack cavity, the outermost conductors cannot be formed with a retroflexed end portion with the presently used housing.

The presently used housing includes a jack opening which is designed to accommodate a modular plug. Accordingly, it has a center opening designed to receive a locking tab of the plug, and side portions which depend from a ceiling and which are spaced apart a distance sufficient to receive a locking tab of a plug therebetween. The width of the locking tab and its shoulders for both six and eight conductor modular plugs is the same. However, if the jack cavity of the present design adapter were to be enlarged to receive eight contact elements and retain the same distance between the side depending portions, curling of the outermost contact element end portions on each side of the jack cavity cannot be accomplished in place. Obstructions formed by the side ceiling portions of the jack cavity inhibit turning of the end portions of the outermost contact elements.

What is needed and what is not provided by the prior art is a modular adapter which includes a housing with which are assembled easily several contact elements that extend between one jack cavity and another and a plurality of contact elements which extend from the one jack cavity to a plug end. Further, the arrangement of housing and contact elements must be such that the end portions of all the contact elements may be formed easily into retroflexed configurations after having been inserted into the housing.

SUMMARY OF THE INVENTION

The foregoing problems have been solved by the adapter of this invention and by methods and apparatus for making the adapter. The adapter includes a housing having a plug end portion and a jack end portion with the jack end portion including a pair of stacked jack cavities each adapted to receive a modular plug. A first one of the cavities includes a plurality of fins at an entrance end thereof and a plurality of partitions interiorly thereof. Each of the partitions is aligned with one the fins and the second one of the cavities has a floor which includes a pair of spaced notches at an entrance end. The first cavity includes a ceiling having a pair of depending portions. Each of the depending portions is spaced from an adjacent sidewall of the housing.

A plurality of metallic contact elements are disposed in the housing. Each of a first group thereof includes a retroflexed portion that is disposed in the first jack cavity. Each also includes a portion which extends through the housing to the plug end portion of the adapter. A second group of the contact elements provide power connections, for example, between the two cavities. Each has a retroflexed end portion disposed in the first jack cavity and extends through the housing with its other end portion disposed in the second jack cavity and retroflexed. These end portions are held in the notches formed in the floor which defines the second cavity. An outermost one of the contact elements has its retroflexed portion disposed between a partition and its aligned fin and an adjacent sidewall of the housing. Retroflexed end portions of other ones of the contact elements are disposed between adjacent partitions.

Methods and apparatus are provided for inserting the plurality of partially formed contact elements into the housing of the adapter. Tooling is operated to cause portions of each of the first and second group to be supported while the end portions are formed into a retroflexed configuration. A tool which is used to form the end portions of the contact elements in the first jack cavity is adapted to cam the end portion of the outermost contact element outwardly toward the housing sidewall to avoid the depending portion of the housing. This facilitates the bending of the end portion of the outermost contact element to form the retroflexed configuration and to cause it to become disposed between the outermost partition and the sidewall of the housing adjacent to the depending portion.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 2:
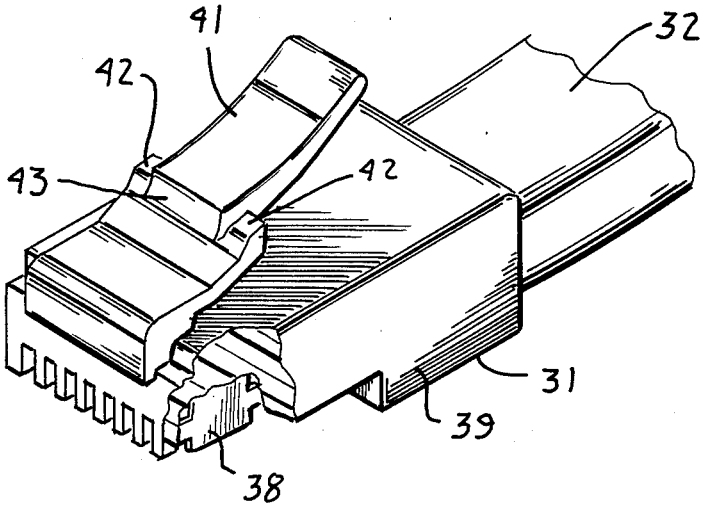
FIG. 2 is a perspective view of a modular plug which is adapted to be received by the adapter of FIG. 1.
Figure 1:
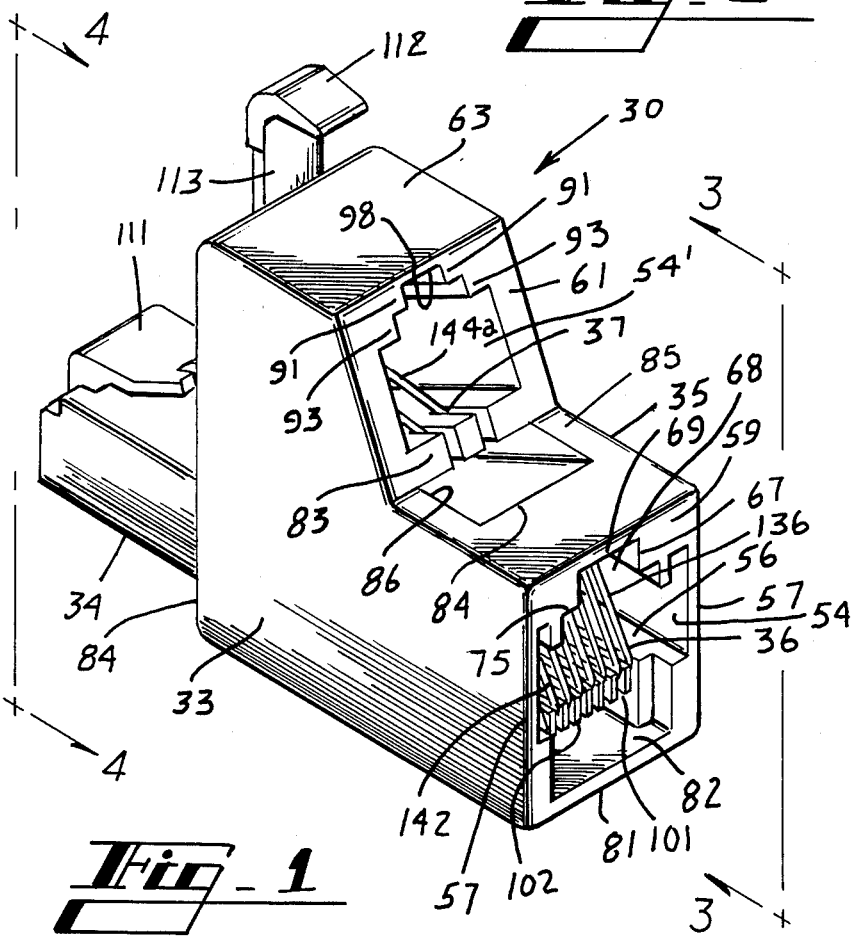
FIG. 1 is a perspective view of an adapter of this invention.

Referring now to FIGS. 1–4, there is shown an adapter, designated generally by the numeral 30 which is used to interconnect two telephone cords 32—32, each of which is terminated with a modular plug 31, with a wall jack (not shown). Portions of the adapter are disclosed in priorly identified U.S. Pat. No. 4,241,974. The adapter 30 includes a housing 33, comprising a plug end portion 34 that is insertable into the wall jack, a jack or cord end portion 35, which is capable of receiving two modular plus 31—31 which terminate cords and a plurality of contact elements 36—36 and 37—37. The contact elements 37—37 typically provide low power connections between portions of the adapter 30.

The modular plug 31 (see FIG. 2), which may be that disclosed and claimed, for example, in U.S. Pat. No. 3,860,316, issued Jan. 2, 1975 in the name of E. C. Hardesty and incorporated by reference hereinto, includes a plurality of blade-like terminals 38—38, which are mounted in a spaced, parallel array in a housing 39 made of a plastic material. Each of the terminals includes a plurality of tangs wich engage electrically an insulated conductor of the cord that is inserted into a cavity in the plug 31. Further, each of the terminals 38—38 include an exposed edge surface which is adapted to be engaged by an associated contact element of the jack portion 35 into which the plug is inserted. Each plug 31 includes a retaining clip 41 which is cammed downwardly as the plug is inserted into the jack portion 35 and which is depressed manually to remove it. It should be observed that the retaining clip has two widths, that of shoulders 42—42 and that of a neck 43. As is seen in FIG. 2, the width of the shoulders 42—42 is greater than that of the neck 43.

The wall jack may be one such as is disclosed for example, in U.S. Pat. No. 3,850,497, which was issued on Nov. 26, 1974 in the names of C. L. Krumreich et al and which is incorporated by reference hereinto. It comprises a dielectric support having a plug-receiving cavity that opens to the front of the support and orifices that extend from the front to the rear of the support along one side of the cavity. An external component in the form of a wire-spring contact is received in each orifice with free end portions of the contacts being retroflexed so that they extend rearwardly in cantilever fashion within the plug-receiving cavity. The free end portions of the wire-spring contacts provide the electrical connection with associated ones of the contact elements 36—36 of the mating adapter 30.

The housing 33 is made from a material such as, for example, polycarbonate. As can best be seen in FIGS. 1 and 3, the housing 33 is made so that its jack end portion 35 includes two stacked, externally communicating cavities 54–54' each of which is designed to receive and conform to the configuration of the housing of a modular plug 31. The jack cavity 54 may be referred to as the first or lower jack cavity and the cavity 54' as the second or upper jack cavity. The jack end portion 35 includes a floor 56, two sidewalls 57—57, an end wall 58 (see FIG. 5) which is oriented toward the plug end portion and an opposite end wall 59. The jack end portion 35 also includes a sloping surface 61 which is joined to a top surface 63.

Figure 3:
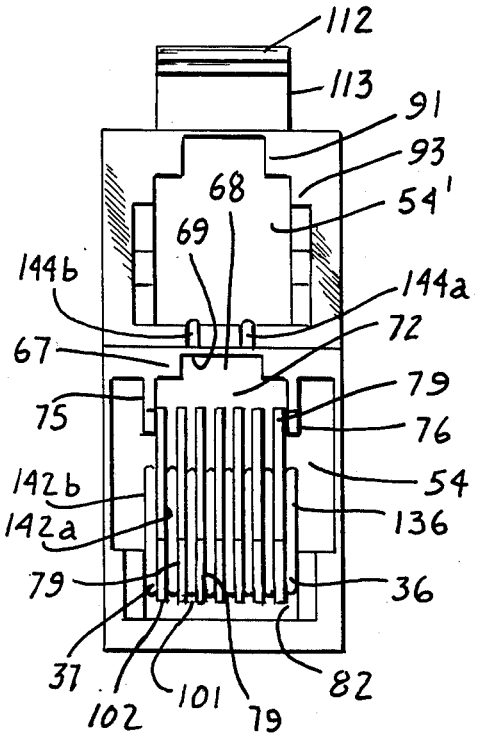
FIG. 3 is an end view of the adapter of FIG. 1 taken along lines 3—3 thereof to show two stacked jack cavities.
Figure 5:
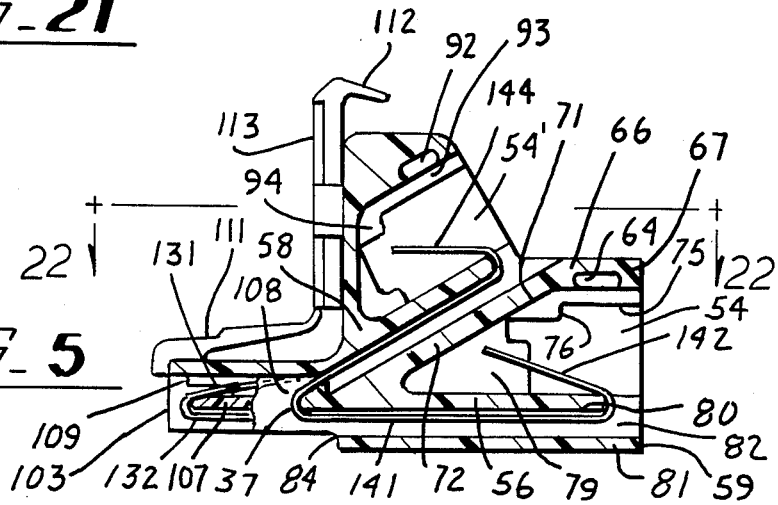
FIG. 5 is a side elevational view partially in section of the adapter of FIG. 1.

Turning now to FIGS. 3 and 5, it can be seen that the lowermost cavity 54 opens to an outer surface of the end wall 59 and includes upper notches 64—64 which open through inner ledges 66—66 and outer steps 67—67 to a pocket 68 having a roof 69 and a rear wall 71. The inner end of the rear wall 71 of the pocket 68 joins to a ceiling 72 of the main portion of the cavity 54. The notches 64—64 are spaced apart a distance which is equal to the width of the neck 43 of the locking tab of a modular plug 31 and are adapted to receive the shoulders 42—42 to lock the plug in the cavity.

Integral with the outer surface of each ledge 66 and step 67 is a depending portion or guide rail 75. The depending portions 75—75 extend below the notches 64—64 and toward the plug end of the housing. Depending from the ceiling 72 of the cavity 54 are a plurality of partitions 79—79. These extend to 36—36 and 37—37 therebetween. At an interior point, the depending portions 75—75 extend still lower through a step 76 (see FIG. 5) and then join into the main body of the plug housing adjacent to exterior ones of the partitions 79—79. The step 76 is effective to limit insertion of a plug 31. The distance between the vertical inner surfaces of the depending portions 75—75 is equal to the overall width of the shoulders 42—42 of the locking tab. As can be seen in FIG. 3, each depending portion is spaced from an adjacent sidewall.

A lowermost portion of the floor 56 includes a surface 80 which extends toward the plug end portion of the adapter 30 and which together wtih a bottom wall 81 of the housing define a rectangular conduit 82 (see FIG. 1) for receiving electrical connecting facilities such as the contact elements 36—36 and 37—37. The conduit 82 terminates in a wall 84 at the junction of the plug end portion 34 and the jack end portion 35 of the adapter 30.

The upper stacked cavity 54' is configured similar to the cavity 54. A bottom wall 83 of the upper cavity 54', a surface 84 and sidewalls 85—85 of the housing define a passaeway 86 which is adapted to receive electrical connecting facilities to be described hereafter.

As can be seen from the drawings, the upper jack cavity 54' includes spaced ledges 91—91 each having a notch 92. The ledges are spaced apart a distance to provide a pocket 98 which is capable of receiving the neck 43 of the locking tab 41 of a modular plug 31 therebetween. Interposed between each ledge and a side wall of the housing is a spacer 93 which extends from the entrance of the jack cavity inwardly. Each spacer has a step 94 interiorly thereof to halt the insertion of a modular plug. The distance between the spacers 93—93 is sufficient to receive the shoulders 42—42 of a plug 31 therebetween. Unlike the depending portions 75—75 in the cavity 54, the spacers 93—93 are uninterrupted between the associated ledge and sidewall of the housing.

When a modular plug 31 of a modular cord has been inserted into one of the cavities 54–54', the retaining clip 41 of the plug returns upwardly to a generally non-depressed position so that it snap-locks into the pocket 68 or the pocket 98 (see FIG. 1) of the cavity and retains the plug within the adapter 30 during use. As with any modular jack and plug arrangement, the removal of the plug requires only the manual depression of the retaining clip 41 followed by the withdrawal of the plug from the cavity into which it had been inserted.

Referring to FIG. 3 of the drawings, it can be seen that the jack cavity 54 comprises a plurality of contact-receivig channels or grooves 101—101 which are formed between fins 102—102. On the underside of the floor 56, the fins 102—102 extend to an end wall 103 of the plug end portion. On the upper side of the floor 56, the fins 102—102 merge with the partitions 79—79 which are recessed within the cavity 54. Each of the channels 101—101 extends between the associated floor 56 and housing wall 81 between the entrance to the cavity 54 and the plug end and effectively provides a compartment for an electrical contact element 36 or 37.

Figure 4:
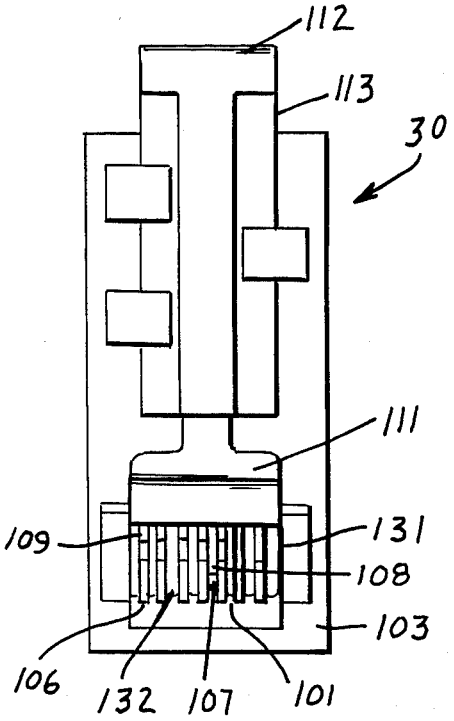
FIG. 4 is an end view of the adapter of FIG. 1 taken along lines 4—4 thereof.
Figure 6:
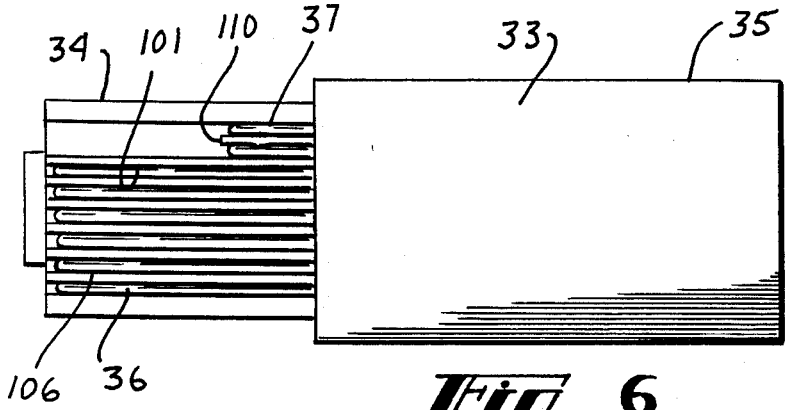
FIG. 6 is a plan view of an underside of the adapter of FIG. 1.

Going now to FIGS. 4, 5 and 6, it can be seen that the plug end portion includes six of the of parallel contact receiving channels 101—101. The channels 101—101 in the plug end portion are separated from one another by a plurality of fins 106—106 which are spaced apart on centers that correspond to the center-to-center spacing of the terminals in a modular plug. The spacing between the channels 101—101 is the same as the spacing between the channels in the cavity 54, with each channel in the plug portion being associated, aligned with, and in communication with a channel in the cavity 54. As seen in FIG. 4, the portion of each channel 101 in the plug end portion which communicates with the cavity 54 is separated vertically from a portion opening to a channel 108 which communicates with the upper cavity 54' by a separator 107 that extends between the adjacent fins. The separators 107—107 are formed so that their free ends are spaced a predetermined distance from the end wall 103 of the plug portion. Also, the ceiling of the portion formed between the separators 107—107 and the outer wall of the housing includes a plurality of depending portions 109—109 which are aligned with associated ones of the fins 106—106 which define the channels 101—101.

Further, as can be seen in FIG. 6 of the drawings, one fin 110 and its associated separators are recessed in the plug end portion of the housing. The two channels associated with these two separators are destined to receive portions of the contact elements 37—37, two in number, which extend between the jack cavity 54 and the upper jack cavity 54'. The other contact elements 36—36, six in total, extend from the jack cavity 54 to the plug end portion.

A description of the housing is completed by the description of a resilient retaining or latch clip 111 (see again FIG. 5) which is adjacent a top of the plug end portion of the housing and which extends toward the wall 58. The latch clip 111 is depressed by a slidably mounted plunger 113 which is integral with an upper portion 112. As an adapter 30 is inserted into a wall terminal, the latch clip 111 is depressed by its engagement with a surface of the jack and becomes locked in the jack. Then, when it is desired to withdraw the adapter 30, a user pushes downwardly on the portion 112 to cause the plunger 113 to depress the latch clip 111 and moves slidably the adapter from the wall jack.

The adapter 30 further includes a plurality of aforementioned contact elements 36—36 and 37—37 in the form of a wire made from a high tensile strength spring material such as, for example, spring temper Phosphor bronze alloy. Each contact element 36 of this invention is formed to provide a first portion 131 (see FIG. 5), which is retroflexed and which is positioned within one of the wire-receiving channels 101—101 of the plug portion, the channel being slightly larger in cross-section than the contact element. The contact elements 36—36 are positioned with the channels 101—101 with a portion 132 of each exposed to the outer surface of the plug end portion so that they can be engaged by associated ones of the wire contacts in the jack cavity into which the plug portion is inserted.

In addition, each contact element 36 is formed to provide a second portion 135 (see FIG. 7A) that extends through the conduit 82 into an aligned channel in the jack cavity 54. The portion 135 has its free end 136 (see FIG. 1) formed into a hook-like configuration designed to be engaged by an associated terminal of a plug which is inserted into the cavity 54.

On the other hand, each of the two contact elements 37—37 includes a portion 141 (see FIG. 7B) that extends along an aligned associated channel 101 (see FIG. 5) in the jack cavity 54. A retroflexed portion 142 that is exposed within the cavity 54 is adapted to be engaged by a terminal of a plug inserted into the jack cavity 54. One of the contact elements 37—37 has end portions designated **142*a* and 144*a* (see FIG. 8) whereas the other one has end portions designated 142*b* and 144*b* (see FIG. 9). The second end portion 144 (see FIG. 5) of each contact element 37 is retroflexed and positioned in the jack cavity 54' and generally centered therein (see also FIG. 3). With the adapter 30, the terminals of the plugs are connected in parallel through the end portions 142 and 144** to the portions of the contact elements which are exposed at the plug end portion and hence to the aligned contacts of the jack.

Whereas the first group of contact elements 36—36 extend from the jack cavity 54 to the plug portion, the second group of contact elements 37—37, comprisig two, extend from the jack cavity 54 to the plug portion and on into the other jack cavity 54'. These two contact elements occupy the two positions in the jack cavity 54 which are adjacent to the left wall 57 as viewed in FIG. 3. However, as also can be seen in FIG. 3, in the other jack cavity, they are spaced on either side of the centerline of the adapter 30.

Figure 7A:
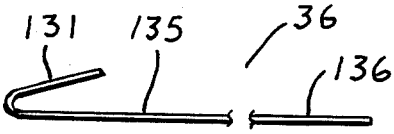
FIGS. 7A and 7B are side elevational views of contact elements to be assembled to a housing.
Figure 7B:
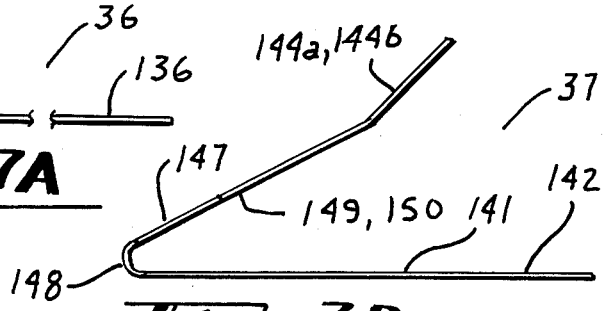
Figure 8:
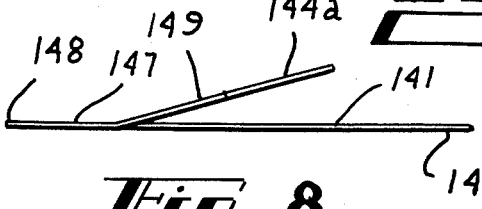
FIGS. 8–9 are plan views of contact elements having the side configuration shown in FIG. 7B.
Figure 9:
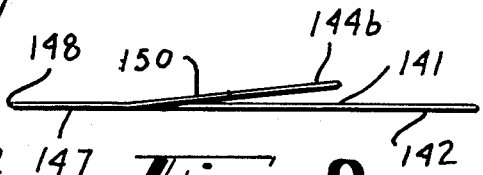

The capability of having offset end portions of the two contact elements 37—37 is provided by preforming those contact elements so that end portions **144*a* and 144*b* are angled from the portion 141 (see FIGS. 7B and 8–9). As a result, when they are inserted into the plug end portion of the housing of the adapter, the end portions 144*a* and 144*b* thereof tend toward the center of the jack cavity 54'. Further, as can be seen by comparing FIGS. 8 and 9, portions 149 and 150, which connect the end portions 144*a* and 144*b*, respectively, through a portion 147 to a closed end portion 148 of each, depart at different angles from a plane through the portions 141 and 147 of each. As a result, when the contact elements 37—37 are positioned in the housing 33, the portion 144*a* becomes disposed on one side of the centerline of the adapter and the portion 144*b* on the other side thereof (see FIG. 3**).

Also of importance is the modification of two of the compartments in the plug end portion 34 which are destined to receive these two contact elements 37—37. The fin 110 and separators which form these two compartments are recessed (see FIG. 6) in the plug end so that when the contact elements 37—37 are inserted therein, the nose end portions 148—148 are substantially closer to the wall 58 than are the nose portions of the contact elements 36—36.

Returning now to FIG. 1, it can be seen that a ceiling portion of the lower jack cavity 54 includes the two depending portions 75—75. As will be recalled, the two depending portions are spaced apart a distance so that the shoulders 42—42 of a locking tab 41 of a modular plug 31 are capable of being received therebetween. It should be noted that the width of the plug locking tab is the same in the six and eight terminal blade plugs.

What is different is that in the adapter 30 of this invention, the depending portions 75—75 are spaced from the adjacent sidewalls 57—57 of the adapter housing 33 while maintaining the clearance between them to permit insertion of a plug locking tab. Because the depending portions 75—75 are spaced from the sidewalls 57—57, the forming of the retroflexed end portions of the contact elements is facilitated. If the ceiling were to be formed as before in a prior art four or six terminal adapter, the turning of the end portions of the two contact end portions nearest the sidewalls 57—57 would engage that ceiling portion and further turning would be impeded.

The depending portions 75—75 in the first jack cavity 54 are configured to meet particular requirememts of the adapter. Each must have sufficient width so that the two cooperate to receive a plug therebetween with substantially no flexure thereof. Secondly, they must be sufficiently thin to provide sufficient space between each and the adjacent sidewall of the housing to allow the end portions of the outer one of the contact elements 37—37 and the outer one of the contact elements 36—36 to be moved therebetween. As a result, each becomes disposed between an outermost partition 79 and an adjacent sidewall.

In the assembly of the housing, a first plurality of contact elements 36—36 each having the side elevational configuration shown in FIG. 7A are inserted into the plug end portion 34 of the housing 33. Each of the first group is inserted to cause one end portion to become disposed in the lower jack cavity and the nose end thereof to be oriented toward the plug end. Each preformed contact element is inserted until its nose end engages a separator 107 extending between fins at the plug end portion.

Then the end portions 136—136 of the contact elements which have been received in the jack cavities are caused to be formed into a retroflexed configuration. For apparatus which is effective to accomplish this, see priorly mentioned application Ser. No. 654,182 which was filed on Aug. 29, 1984 in the name of E. M. Hutchins.

Figure 10:
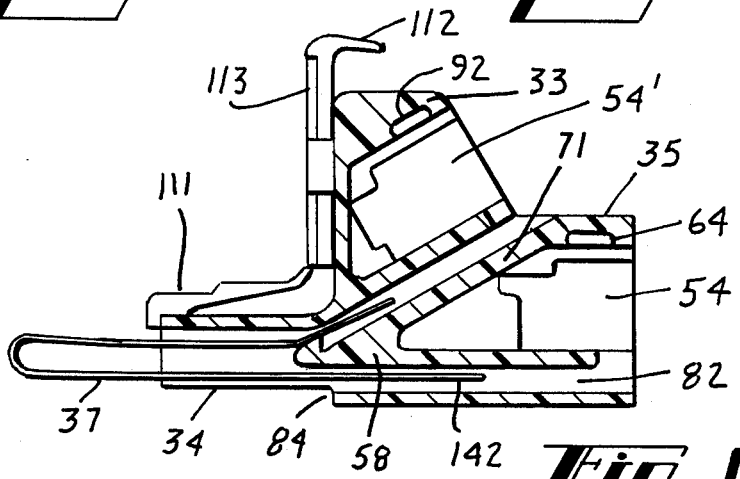
FIG. 10 is a side elevational view which shows a contact element inserted partially into a housing.

Afterwards, two partially formed contact elements 37—37 which are to provide power connections, for example, between the two jack cavities 54 and 54' are inserted partially into the plug end portion 34 of the housing 33 (see FIG. 10). It will be observed from FIG. 8–9 that upper end portions of those contact elements are spaced out of plane from the other end portions.

Figure 11:
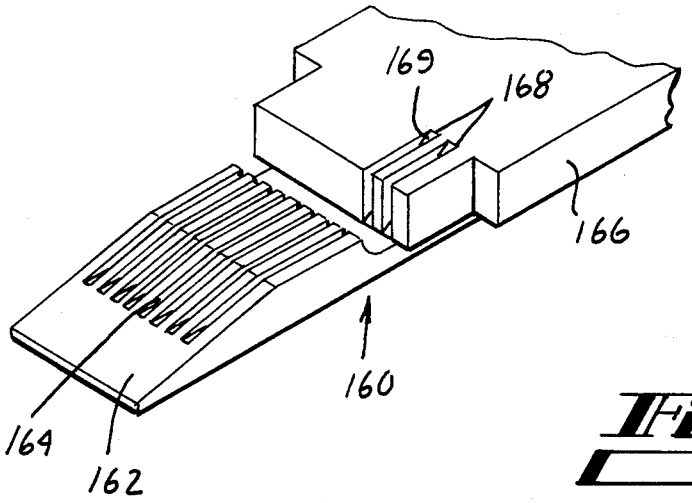
FIG. 11 is a perspective view of tooling which is used to support contact elements in a lower jack cavity during end forming.
Figure 12:
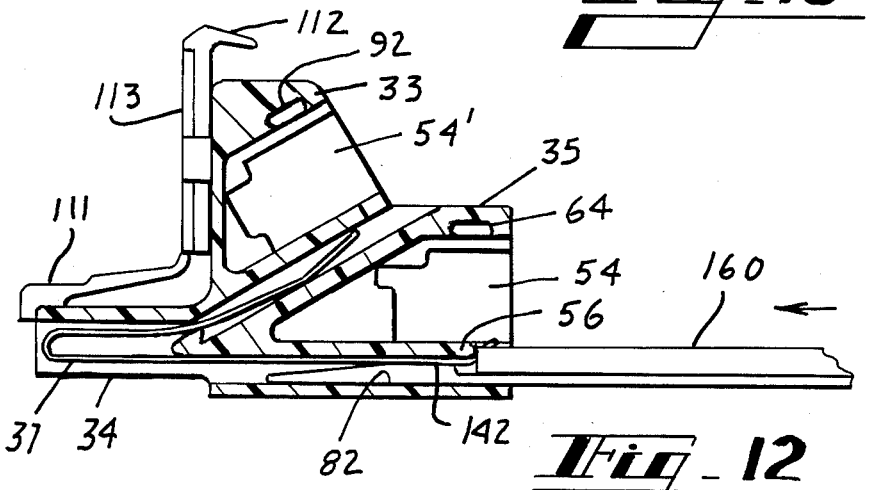
FIG. 12 is an elevational view of tooling which has been inserted into a lower one of the jack cavities to support contact element portions in the lower jack cavity prior to forming their ends.

Prior to full insertion of the contact elements 37—37, a support tool 160 (see FIG. 11) is moved into the jack cavity 54 beneath its floor (see FIG. 12) to support the lower portions of the two contact elements therein. The tool 160 includes a sloped end 162 having a plurality of grooves 164—164 therein and a body portion 166 having two grooves 168—168 therein. Each of the grooves 168—168 has an inclined floor 169. As the tool is moved into the jack cavity 54, the contact elements 36—36 and 37—37 are received on the surfaces formed between the grooves 164—164. The fins formed along the floor 56 and extending into the conduit 82 are received in the grooves 164—164. As a result, the lower portions of the contact elements are confined between the floor 56, the surfaces between the grooves 164—164 and the fins extending from the floor 56. End portions of the two contact elements are caused to ramp up along the inclined floors 169—169 to become ready to be engaged by a forming tool.

Figure 13:
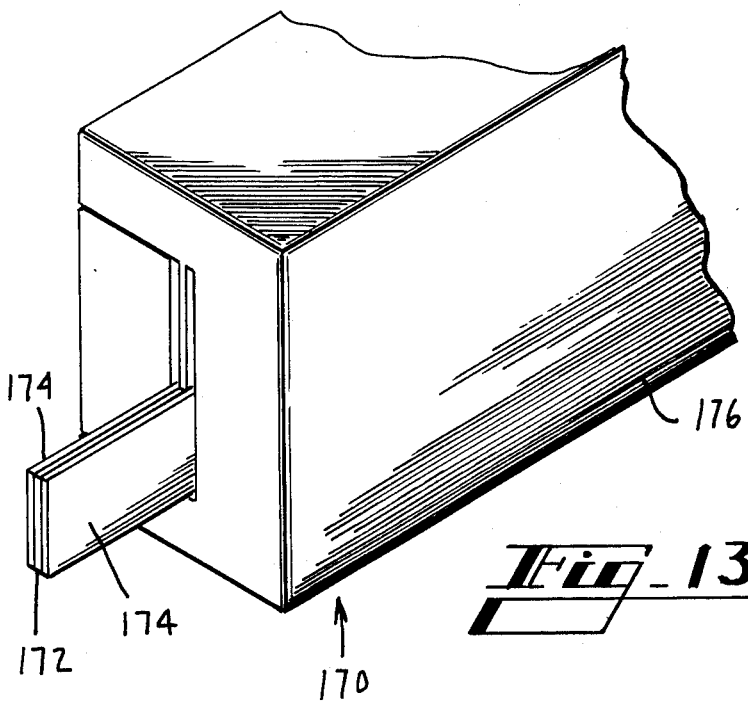
FIG. 13 is a perspective view of tooling which is used to insert contact elements.
Figure 14:
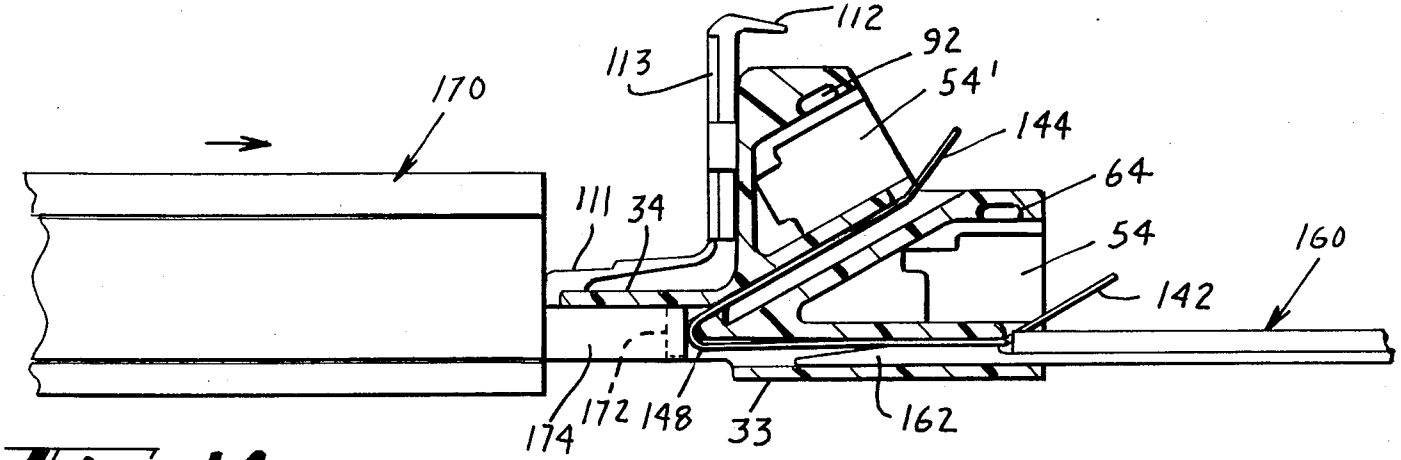
FIG. 14 is a side elevational view which shows the tooling of FIG. 13 being used to engage the contact elements.

The contact elements 37—37 are pushed farther into the plug end by a forming tool 179 (see FIG. 13) having a spring-biased center portion 172 until the nose end 148 of these contact elements are moved farther inwardly than the other six. As the tool 172 is moved into the plug end of the housing (see FIG. 14), side blades 174—174 engage the nose ends of the contact elements and push them into engagement with the separators in the plug end. As this occurs, the middle spring-biased portion 172 engages the fin therebetween and becomes moved into a housing 176 of the tool.

Figure 17B:
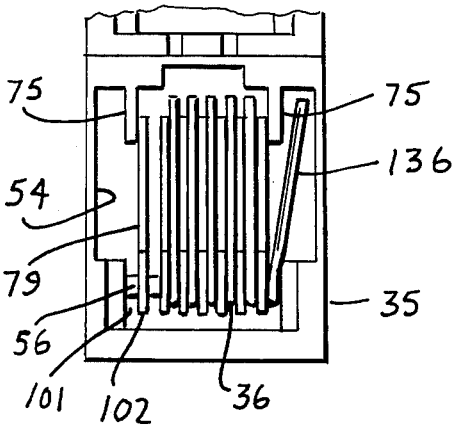
FIGS. 17A and 17B are end views which show end portions of outermost contact elements being formed.
Figure 17A:
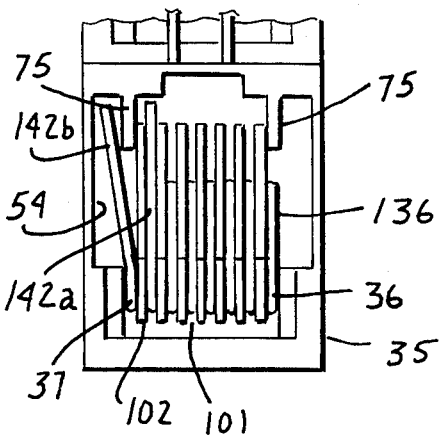
Figure 15:
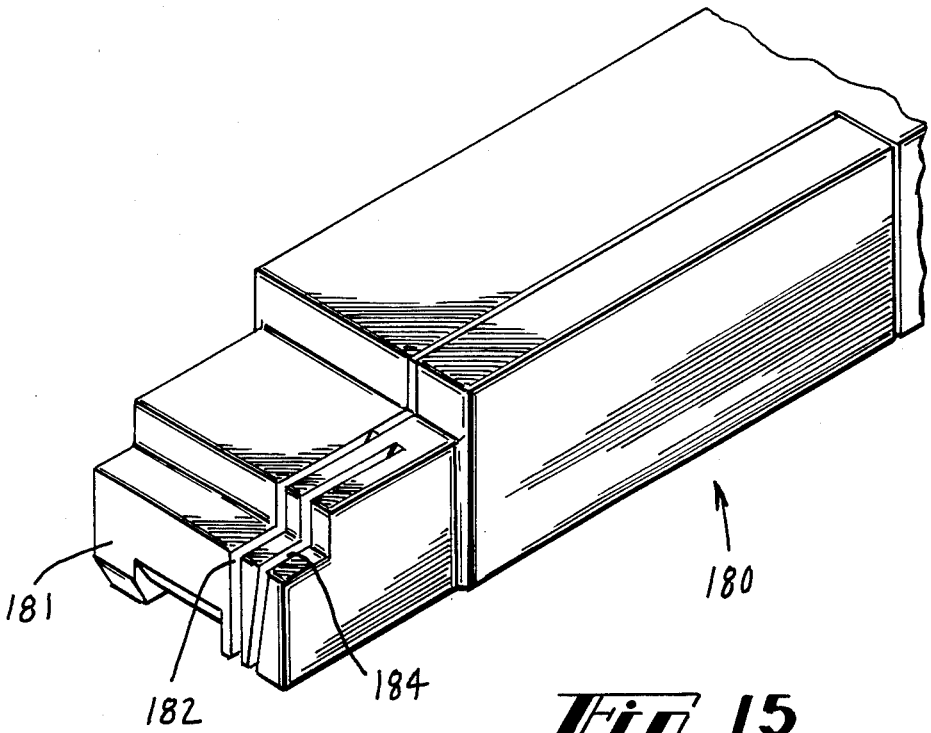
FIG. 15 is a perspective view of tooling which is used to form end portions of the two contact elements in the lower one of the jack cavities.
Figure 16:
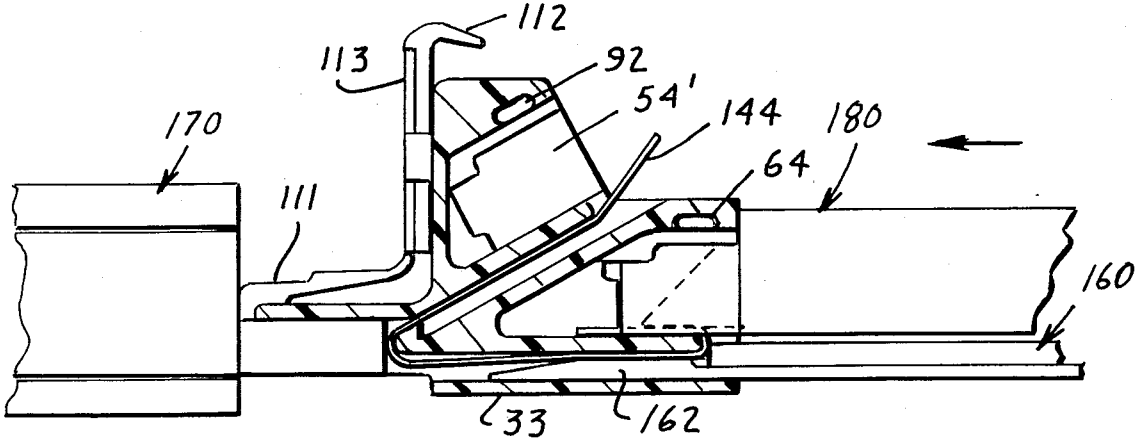
FIG. 16 is a side elevational view of the tooling of FIG. 15 in an operated position to form end portions of the contact elements.

Then a forming tool 180 (see FIGS. 15 and 16) is moved to engage the end portions of the two contact elements in the cavity 54. As can be seen in FIG. 15, an end portion 181 of the forming tool 180 has one slot 182 which is parallel to a plane containing any of the other six contact elements 36—36. The other slot 184 in the end of the forming tool is inclined toward the outside so that when it engages the end portion of the outermost contact element 37, it cams it outwardly (see FIG. 17A) as it curls it into a retroflexed configuration. As a result, the end portion becomes disposed between the depending portion 75 and the sidewall 57 of the housing. FIG. 17B depicts the forming of the end portions 136—136 of the contact elements 36—36 and shows an outermost one thereof being moved past the right one of the depending portions 75—75. As is seen in FIG. 17a, the contact elements have sufficient resiliency so that after outermost ones clear the depending portions, they spring back to be adjacent an outermost partition 79.

Figure 19:
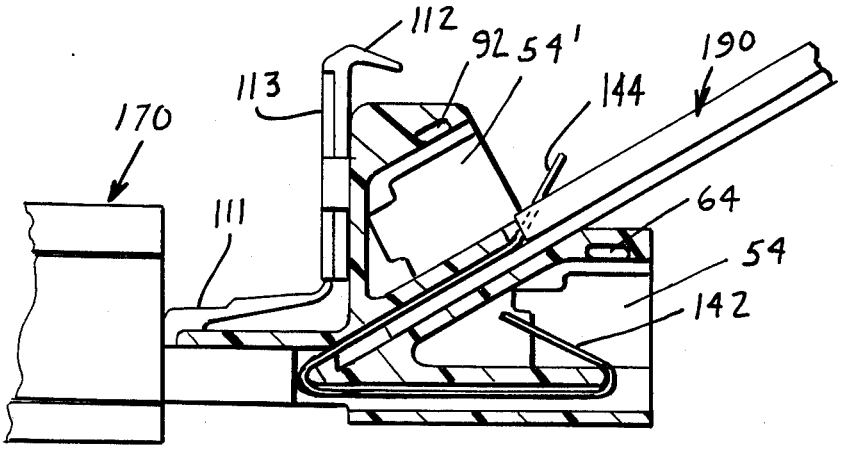
FIG. 19 is a side elevational view which shows the tooling of FIG. 18 in an operative position.
Figure 18:
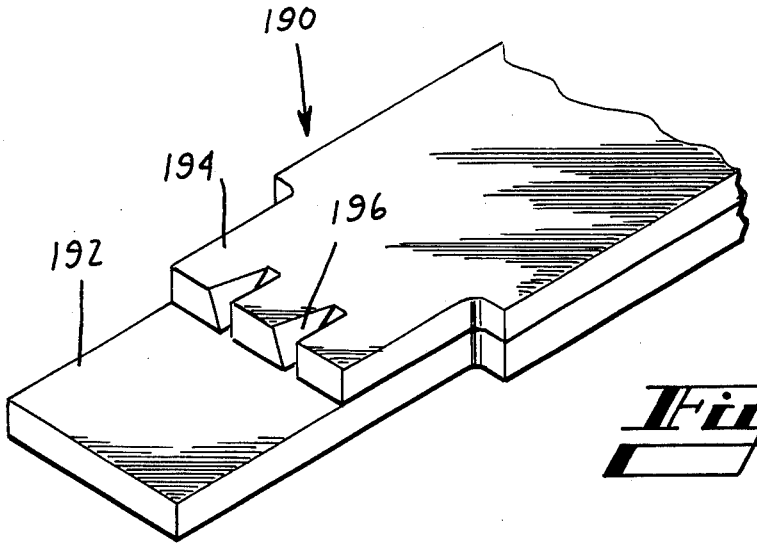
FIG. 18 is a perspective view of tooling which is used to support the end portions of the contact elements in the upper jack cavity.

Afterwards, tooling is operated to cause the end portions of the contact elements 37—37 which are disposed in the jack cavity 54' to become disposed in a retroflexed configuration. A tool 190 (see FIG. 18) having a base portion 192 and a support portion 194 is moved into the cavity 54' (see FIG. 19). As can be seen in FIG. 18, the support portion 194 includes two notches 196—196 which are adapted to be aligned with the notches in the floor of the cavity 54'. The end portions **144*a* and 144*b* of the contact elements 37—37 extend through the notches 196—196**.

Figure 21:
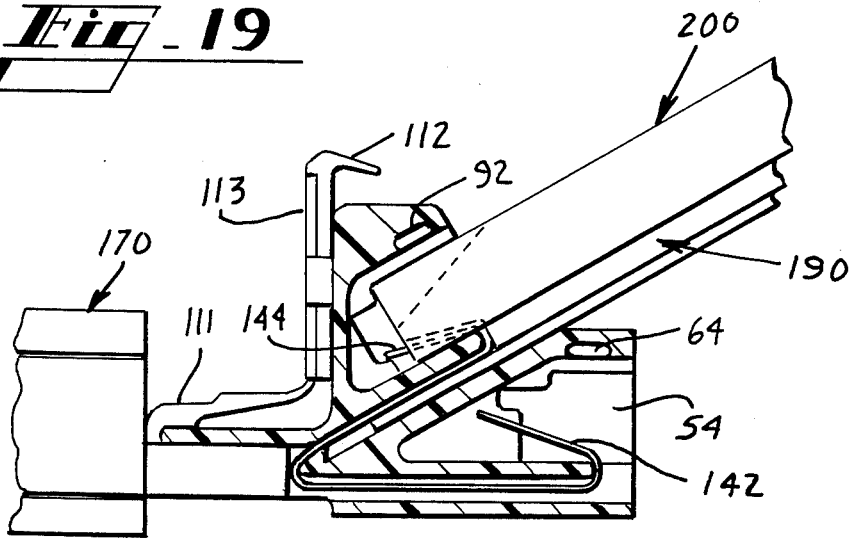
FIG. 21 is a view which shows the seating and forming of the end portions of the contact elements in the upper jack cavity in an adapter of this invention.
Figure 20:
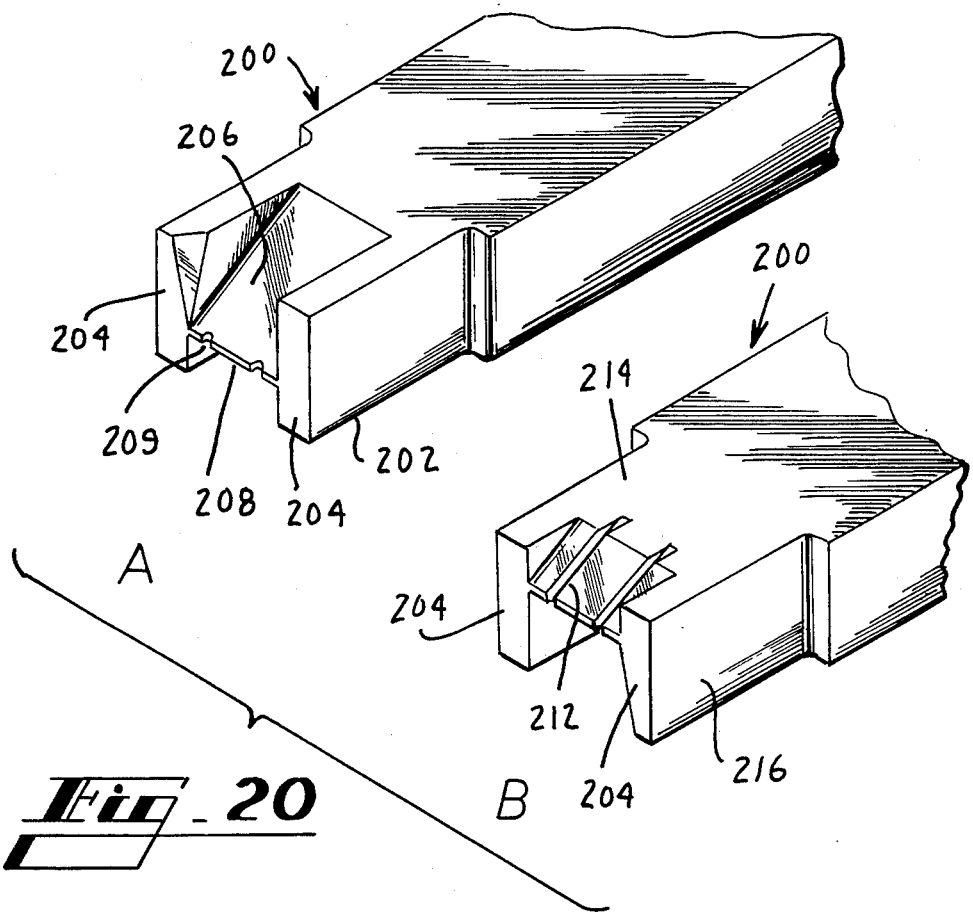
FIGS. 20A and 20B are perspective views of tooling used to cause end portions of the contact elements in the upper jack cavity to have a retroflexed configuration.

Then a tool 200 (see FIG. 20A and 20B) is moved to engage the end portions of the contact elements 37—37 (see FIG. 21). The tool 200 in its normal operative orientation is shown in FIG. 20A and from its underside in FIG. 20B. It includes an end portion 202 having two side walls 204—204 with an inclined surface 206 therebetween. A front edge surface 208 of the inclined portion includes two spaced notches 209—209. On its underside, the notches 209—209 of the inclined portion 206 extend in slots 212—212 to a surface 214 of a main body portion 216 of the tool 200.

Figure 22:
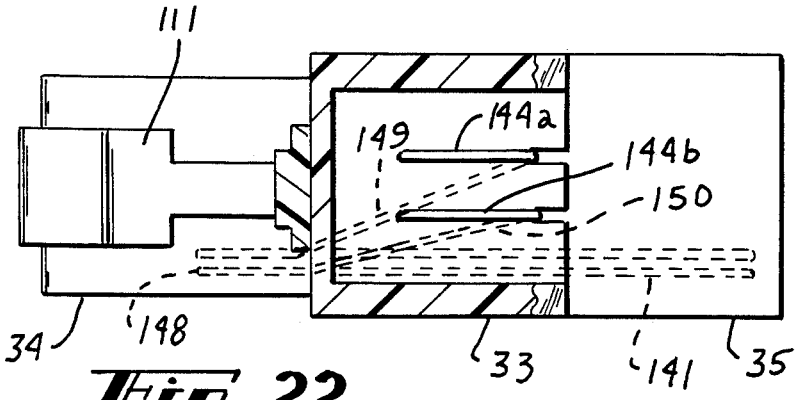
FIG. 22 is a plan view of the adapter of this invention which shows the contact elements which extend from the lower jack cavity to the upper jack cavity.

As the tool 200 is moved inwardly of the cavity 54' (see FIG. 21), the end portions of the contact elements 37—37 which extend through the notches 196—196 are received in the aligned notches 209—209. Further movement of the tool 200 causes them to be received in the slots 212—212 on the underside of the tool until they are retroflexed and assume the positions shown in FIG. 22.

It is to be understood that the above-described arrangements are simply illustrative of the invention. Other arrangements may be devised by those skilled in the art which will embody the principles of the invention and fall within the spirit and scope thereof.

What is claimed is:

1. A modular adapter having one end portion capable of being inserted into a jack cavity and another end portion capable of receiving modular plugs, said adapter comprising:

a housing having a plug end portion for receipt in a jack cavity and a jack end portion having first and second jack cavities, said first jack cavity being defined by a plurality of spaced partitions, a ceiling and portions depending from said ceiling and spaced apart a distance equal to a width of a locking tab of a plug destined to be received therein, each of the depending portions in said first cavity being spaced from an adjacent sidewall of the housing and disposed between an outermost one of the partitions and the adjacent sidewall; and a plurality of metallic contact elements including a first group each of which extends from a retroflexed end portion thereof in the first jack cavity to said plug end portion and a second group each of which extends from the first jack cavity to the second jack cavity with each end of each contact element of said second group having a retroflexed configuration, the retroflexed end portion of at least one of said contact elements in said first cavity being disposed in a receiving space formed between one of the outermost partitions and an adjacent spaced sidewall of said housing and the retroflexed end portions of other ones of said contact elements in said first cavity being disposed between adjacent partitions.

2. A modular adapter having one end portion capable of being inserted into a jack cavity and the opposite end portion capable of receiving modular plugs, said adapter comprising:

a housing having a plug end portion for receipt in a jack cavity and a jack end portion having first and second jack cavities, each said cavity being defined by a ceiling and portions depending from said ceiling and spaced apart a distance equal to a width of a locking tab of a plug destined to be received therein, said housing including a plurality of spaced partitions disposed in said first cavity with each of said depending portions in said first cavity being adjacent to an outermost one of said partitions;

a first plurality of metallic contact elements which extend from the first jack cavity to said plug end portion, each of said first plurality having a retroflexed end portion which is disposed in said first jack cavity with the retroflexed portion of at least one of said first plurality being disposed between an outermost one of said partitions in said first jack cavity and one of the adjacent sidewalls of the housing and the retroflexed end portions of other ones of said first plurality being disposed between adjacent partitions; and a second plurality of metallic contact elements which extend from the first jack cavity to the plug end portion and to the second jack cavity, each end of each of said second plurality having a retroflexed configuration with the retroflexed end portion of one of said second plurality in said first cavity being disposed between an outermost one of said partitions and the adjacent sidewall of the housing, each of said depending portions being spaced from an adjacent sidewall of the housing a distance which is sufficient to permit an end portion of a contact element to be turned between it and the adjacent sidewall of the housing to form a retroflexed configuration.

3. The adapter of claim 2, wherein each of the depending portions in said first jack cavity has sufficient thickness to support a plug which is inserted into the jack cavity and is spaced a sufficient distance from a sidewall of the housing to permit an end portion of a contact element to be turned therepast without excessive bending of the contact element, each of the depending portions being provided with a step to limit insertion of a plug into the associated cavity of the jack end portion.

4. The adapter of claim 2, wherein said contact elements which extend between said first and second jack cavities are preformed such that each said contact element has an upper end portion which departs from a remaining portion at a point such that when the contact element is inserted into the housing, the point coincides with a lip at an entrance to the second jack cavity of the housing, the point at which the remaining portion of one contact element of the second plurality departs from the portion which extends from the first cavity to the plug end portion being different from that of another one of the contact elements of the second plurality.

5. The adapter of claim 2, wherein the second plurality of contact elements include two contact elements each of which has a closed end portion which is recessed in the plug end portion from closed ends of the first plurality.

6. The adapter of claim 5, wherein each of the contact elements which extends between jack cavities includes an end portion in the second jack cavity which is spaced out of a plane in which is disposed the end portion in the first jack cavity and the closed end portion in said plug portion.

7. The adapter of claim 6, wherein the housing includes a floor which defines said second cavity, said floor including two spaced notches for receiving portions of the retroflexed end portions of the two contact elements.

8. A modular adapter which is adapted to have one end inserted into a jack and another end having stacked jack cavities, said adapter including:

a housing having a plug end portion and a jack end portion, said jack end portion including first and second stacked jack cavities each adapted to receive a modular plug, said first cavity having a plurality of fins at an entrance end thereof and a plurality of partitions interiorly thereof, each of said partitions being aligned with one of the fins, said second cavity having a floor which includes a pair of spaced notches at an entrance end thereof, said first cavity including a ceiling having a pair of spaced depending portions;

a first plurality of metallic contact elements, each of which includes a retroflexed portion which is disposed in said first jack cavity and having a portion which extends through said housing to said plug end portion of said adapter, the retroflexed portion of an outer one of said first plurality being disposed between a partition and its aligned fin and an adjacent spaced sidewall of the housing with the retroflexed portions of the remaining contact elements of said first plurality each being disposed between adjacent ones of said fins and partitions; and a second plurality of metallic contact elements comprising two contact elements each having a retroflexed end portion disposed in said first jack cavity with an outermost one of said second plurality being disposed between a partition and associated fin and an adjacent spaced sidewall of said housing, said second plurality of contact elements extending through said housing and having other end portions thereof disposed in said second jack cavity and being retroflexed and held in said notches formed in said floor thereof, the end portions of each of said second plurality being disposed in spaced planes, each said depending portion of said housing being spaced from an adjacent sidewall of said housing a distance which is sufficient to permit an end portion of a contact element to be turned between it and the adjacent sidewall of the housing to form a retroflexed configuration and with said partitions being disposed between said depending portions.

9. A modular adapter housing having one end capable of being inserted into a jack cavity and another end capable of receiving modular plugs, said adapter comprising:

a plug end portion adapted to be received in a jack cavity and including a plurality of contact-element receiving channels; and a jack end portion which includes first and second plug-receiving cavities, said first cavity being defined by a plurality of contact element receiving channels which are aligned with those in said plug end, a ceiling, a plurality of partitions with each two adjacent partitions adapted to receive an end portion of a contact element therebetween, and two guide rails depending from said ceiling, each of said rails being spaced from an adjacent sidewall of the housing a distance which is sufficient to permit an end portion of a contact element to be turned between it and the adjacent sidewall of the housing to form a retroflexed configuration and become disposed between an outermost one of said partitions and the adjacent sidewall of the housing, the depending portions being spaced apart a sufficient distance to permit a latching clip of a modular plug to be received therebetween, and each having a thickness which is sufficient to prevent substantially any deflection when a modular plug is inserted therebetween.

10. A method of assembling a wire-like contact element and dielectric unipartite housing having an opening in a plug end portion which communicates with first and second cavities in a jack end portion, said method including the steps of:

inserting a preformed contact element into the plug end portion to cause one free end thereof to become disposed in the first jack cavity and the other free and to become disposed in the second jack cavity;

inserting a first support tool into the first jack cavity;

moving the contact element farther into the plug end portion of the housing to cause the one free end to be cammed upwardly on the support tool;

moving a forming tool inwardly toward the first jack cavity to engage the one end of the contact element and to cam it outwardly toward a side wall of the housing to clear a depending ceiling portion in the first jack cavity which is spaced from an adjacent sidewall while forming it into a retroflexed configuration;

inserting a second support tool having a slot into the second jack cavity to engage the other end of the contact element and cam the end thereof into a bottom portion of the slot of the second tool; and moving another forming tool into the second jack cavity to engage the cammed-up end portion of the contact element and cause it to be formed into a retroflexed configuration.

11. The method of claim 10, wherein prior to the assembly of contact elements with the housing such that one free end portion is disposed in the first jack cavity and the other free end portion in the second jack cavity, a plurality of contact elements are assembled to the housing to each have one end portion disposed in the first jack cavity and the other end portion in the plug end portion of the housing.

12. The method of claim 10, which also includes the step of supporting closed ends of two contact elements during the forming of the end portions thereof into a retroflexed configuration in the first and second jack cavities.

13. An apparatus for assembling a wire-like contact element and dielectric unipartite housing having an opening in a plug end portion which communicates with first and second cavities in a jack end portion, said apparatus including:

means for moving a preformed contact element through a first increment of travel into the opening in the plug end portion to cause one free end thereof to become disposed in the first jack cavity and the other free end to become disposed in the second jack cavity;

a first support tool which is adapted to be received in the first jack cavity whereupon said moving means is adapted to be moved through a second increment of travel to cause the one free end of the contact element to be cammed upwardly on the first support tool;

a first forming tool having one slot for engaging the one end of the contact element and turning it upwardly while camming it outwardly toward a side wall of the housing to clear a depending portion of the housing which is disposed in the first jack cavity;

a second support tool adapted to be inserted into the second jack cavity; and a second forming tool adapted to be moved into the second cavity to engage a free end portion of the contact element and to cause it to become disposed in a retroflexed configuration.

14. The apparatus of claim 13, wherein said means for moving includes means for moving two preformed contact elements into the plug end portion and including a body member having three fingers projecting therefrom with a center one of the fingers being spring-biased so that as the contact elements are moved into the plug end portion, the center one thereof engages a separator of said housing and is moved rearwardly into said body member allowing continued forward motion of the other two fingers.

15. The apparatus of claim 13, wherein said second forming tool has an end adapted to be received in the second cavity, the end including two spaced notches which are adapted to engage the end portions of the contact elements in the second cavity as the second forming tool is moved into the second cavity.

16. The apparatus of claim 14, wherein said first support tool is configured to include a plurality of ribs which are received in channels of the adapter when the first support tool is inserted into the first cavity thereof to provide support for the portions of the contact elements in the channels when the end portions of the contact elements in the first cavity are formed into a retroflexed configuration.

17. The apparatus of claim 14, wherein said first forming tool includes a body member having two slots formed in one end thereof, one of said slots being parallel to an axis of the adapter which extends through the two cavities and the other slot inclined thereto to cause the end portion of the outermost contact element to be cammed outwardly between a depending portion in the first cavity and an adjacent sidewall of the housing.

* * * * *